US005436712A

United States Patent [19]

Wayman et al.

[11] Patent Number: 5,436,712

[45] Date of Patent: Jul. 25, 1995

[54] POWER CONTROL FOR INSTANT-ON-INTEGRAL RESISTIVE HEATING BELT FUSER

[75] Inventors: William H. Wayman, Ontario; Rasin Moser, Fairport, both of N.Y.

[73] Assignee: Xerox Corporation, Stamford, Conn.

[21] Appl. No.: 169,838

[22] Filed: Dec. 16, 1993

[51] Int. Cl.[6] ..... G03G 15/20

[52] U.S. Cl. ..... 355/290; 219/216

[58] Field of Search ..... 355/282, 285, 286, 289, 355/290; 219/216

[56] References Cited

U.S. PATENT DOCUMENTS

| | | | |
|---|---|---|---|
| 4,563,073 | 1/1986 | Reynolds | 355/290 X |
| 4,565,439 | 1/1986 | Reynolds | 355/290 |
| 4,994,852 | 2/1991 | Matsuuchi et al. | 355/282 X |
| 5,084,738 | 1/1992 | Ishikawa | 355/285 |
| 5,115,279 | 5/1992 | Nishikawa et al. | 355/290 |
| 5,182,606 | 1/1993 | Yamamoto et al. | 355/289 |
| 5,315,356 | 5/1994 | Nagato et al. | 355/289 |

*Primary Examiner*—Fred L. Braun

[57] ABSTRACT

A power controller, which does not rely on the use of sensors such as thermistors to control the operating temperature of a belt fuser is provided. It features various preset inputs to control; steady state watts/in, cold start boost watts/in, warmup and cooldown time constants.

The controller sets the desired power based on the on-off cycling of the system. For a cold start, the steady state plus boost power is used, during warmup the boost level is exponentially decreased at a rate set by a warmup time constant. When at rest (with no applied power) the power setpoint is exponentially increased at a rate set by a cooldown time constant.

10 Claims, 2 Drawing Sheets

POWER CONTROL FOR INSTANT-ON-INTEGRAL RESISTIVE HEATING BELT FUSER

BACKGROUND OF THE INVENTION

This invention relates to the art of forming powder images and, more particularly, to heat and pressure belt fuser apparatus and, more specifically, to a temperature control therefor.

In the art of xerography or other similar image reproducing arts, a latent electrostatic image is formed on a charge-retentive surface which may comprise a photoconductor which generally comprises a photoconductive insulating material adhered to a conductive backing. When the image is formed on a photoconductor,the photoconductor is first provided with a uniform charge after which it is exposed to a light image of an original document to be reproduced. The latent electrostatic images, thus formed, are rendered visible by applying any one of numerous pigmented resins specifically designed for this purpose.

It should be understood that for the purposes of the present invention the latent electrostatic image may be formed by means other than by the exposure of an electrostatically charged photosensitive member to a light image of an original document. For example, the latent electrostatic image may be generated from information electronically stored or generated, and this information in digital form may be converted to alphanumeric images by image generation electronics and optics. However, such image generation electronic and optic devices form no part of the present invention.

In the case of a reusable photoconductive surface, the pigmented resin, more commonly referred to as toner which forms the visible images is transferred to a substrate such as plain paper. After transfer the images are made to adhere to the substrate using a fuser apparatus. To date, the use of simultaneous heat and contact pressure for fusing toner images has been the most widely accepted commercially, the most common being ones that utilize a pair of pressure engaged rolls.

Heretofore, it has been necessary with the foregoing type of fuser to heat the fuser not only when images are being fused but also during standby when images are not being fused. This is because of the long delay of raising the large thermal mass up to fusing temperature if the heat supply was turned off during standby. Such delays would not be tolerated by the user even though operating the fuser in such a manner would eliminate a substantial waste of energy.

Elimination of fuser standby power has been accomplished in prior art devices such as flash fusers and cold pressure fusers. Both of these types of fusers, however, exhibit other drawbacks. For example, cold pressure fusers exhibit poor quality images and they significantly limit the process speed of imaging machines.

Flash fusers create undesirable effluents and they work very poorly with colored toners, especially the lighter colored ones. Also, the optical density of flash fused images is unsatisfactory. Like cold pressure fusers, flash fusers limit the process speed of the imaging machines in which they are used.

Most if not all the shortcomings enumerated above can be obviated using a thin belt fuser of the type described in U.S. patent application Ser. No. 08/168,833 filed on Dec. 16, 1993. As disclosed therein, only the belt segment disposed in the fusing zone is heated while the rest of the belt is not. The belt fuser disclosed in this application comprises three fuser rollers which cooperate with a pressure roller to form an extended fusing zone through which a substrate carrying toner images passes with the toner images contacting fusing belt. Electrical power is applied to the three fuser rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

Exemplary belt fusers and other patent applications which may be relevant to various aspects of the present invention will now be discussed.

U.S. patent application Ser. No. 08/168,835 filed on Dec. 16, 1993 which is assigned to the same assignee as the instant invention relates to a belt fuser wherein three fuser rollers cooperate with a pressure roller to form an extended fusing zone through which a substrate carrying toner images passes with the toner images contacting fusing belt. Electrical power is applied to the three contact rolls in such a manner that only the portions of the belt in the fusing zone are heated. Thus, the energy is concentrated only in the part of the fusing belt where it is needed for fusing the toner images on the final substrate. Thus, the free extent of the belt or in other words the portion of the belt outside of the fusing zone remains unheated.

To ensure good electrical contact in the presence of silicone oil contamination on the electrically resistive inner surface of the fusing belt, the contact rollers are textured by knurling, bead blasting or other suitable means.

U.S. patent application Ser. No. 08/169,836 filed on Dec. 16, 1993 which is assigned to the same assignee as the instant invention relates to belt fuser wherein three fuser rollers cooperate with a pressure roller to form an extended fusing zone through which a substrate carrying toner images passes with the toner images contacting a fusing belt. Electrical power is applied to the three fuser rolls in such a manner that the portions of the belt between the rollers are heated to a predetermined operating temperature in accordance with a setpoint temperature. The free extent of the belt or in other words the portion of the belt outside of the fusing zone is adapted to be heated to various operating temperatures in order to produce prints with different gloss as desired.

U.S. patent application Ser. No. 08/169,802 filed on Dec. 16, 1993 which is assigned to the same assignee as the instant invention relates to a belt fuser for fusing transparencies without having to resort to off-line methods and apparatus. The toner images which are formed on the transparency during the imaging process have time to cool prior to separation from a smooth-surfaced belt.

The peak fusing temperature is significantly higher than used with conventional fusers such as heat and pressure roll fusers. This higher temperature guarantees excellent toner melting and flow thereby producing transparencies with excellent projection efficiency.

U.S. patent application Ser. No. 08/168,891 filed on Dec. 16, 1993 which is assigned to the same assignee as the instant invention relates to belt fuser wherein three fuser rollers cooperate with a pressure roller to form an extended fusing zone through which a substrate carrying toner images passes with the toner images contacting fusing belt. Electrical power is applied to the three fuser rolls in such a manner that only the portions of the belt in the fusing zone are heated. The energy is concentrated only in the part of the fusing belt where it is needed for fusing the toner images on the final substrate. Thus, the free extent of the belt or in other words the portion of the belt outside of the fusing zone remains unheated. Toner images are directly formed on or transferred to the unheated portion of the fusing belt. The images carried by the belt are then moved through the nip where the images are simultaneously fused and transferred to a final substrate.

U.S. Pat. No. 4,565,439 granted to Scott D. Reynolds on Jan. 21, 1986 relates to a belt fuser for fusing toner images. The fusing apparatus is characterized by the separation of the heat and pressure functions such that the heat and pressure are effected at different locations on a thin flexible belt forming the toner contacting surface. A pressure roll cooperates with a non-rotating mandrel to form a nip through which the belt and copy substrate pass simultaneously. The belt is heated such that by the time it passes through the nip its temperature together with the applied pressure is sufficient for fusing the toner images passing therethrough. The non-rotating mandrel is adapted to having its axis skewed relative to the axis of the pressure roll. A pair of edge sensors are provided for activating a mandrel skewing mechanism. Skewing of the mandrel by such mechanism effects proper belt tracking.

U.S. Pat. No. 4,563,073 granted to Scott D. Reynolds on Jan. 7, 1986 relates to a low mass heat and pressure fuser and release agent management system therefor.

U.S. Pat. No. 5,084,738 granted to Noriyoshi Ishikawa on Jan. 28, 1992 discloses a fusing apparatus having an electrically conductive film which moves in contact with a recording material to which a toner image has been transferred, a pressing roller for causing the film to be brought into contact with the recording material and a plurality of electrodes disposed along a nip between the film and the pressing roller at a position opposing this pressing roller. The electrically conductive film heats up substantially only in the nip as the result of an electrical conductance to this electrode. The toner image on the recording material is heated and fixed by the heat generated in the electrically conductive film positioned in the nip. In a modified embodiment of the foregoing fusing device, a fusing film is fabricated using a thin-film conductive layer made by aluminum deposition or the like. The conductive layer is disposed on the side of a base film comprising carbon black added to a polycarbonate that will contact the transfer material on which a picture image is carried. Power is supplied between a first electrode and a second electrode. Joule heat is produced in the thickness direction of the fusing film.

U.S. Pat. No. 5,182,606 granted on Jan. 26, 1993 discloses an image fusing apparatus including a heater; a film movable with a recording material, in which the recording material has a toner image thereon which is heated through the film by heat from the heater; and the film has a heat resistive resin base layer containing inorganic electrically insulative filler material and a parting layer containing electrically conductive filler material.

BRIEF SUMMARY OF THE INVENTION

Pursuant to the intents and purposes of the present invention, a power controller for a belt fuser is described hereinbelow.

Due to the low mass and rapid warmup time (<80 msec)of the instant-on belt fuser of the present invention, conventional contact thermistor measurement and control systems are considered inadequate for controlling the operating temperature thereof.

Accordingly, a power controller, which does not rely on the use of sensors such as thermistors to control the operating temperature of a belt fuser is provided by the present invention. It features various preset inputs to control steady state power (watts/in), cold start boost (watts/in), warmup and cooldown time constants The controller sets the desired power based on the on-off cycling of the system. There are no sensors used to measure fuser temperature. For a cold start, the steady state plus boost power is used, during warmup the boost level is exponentially decreased at a rate set by a warmup time constant. When at rest (with no applied power) the power setpoint is exponentially increased at a rate set by a cooldown time constant.

DETAILED DESCRIPTION OF THE DRAWINGS

Figures 1A, 1B:
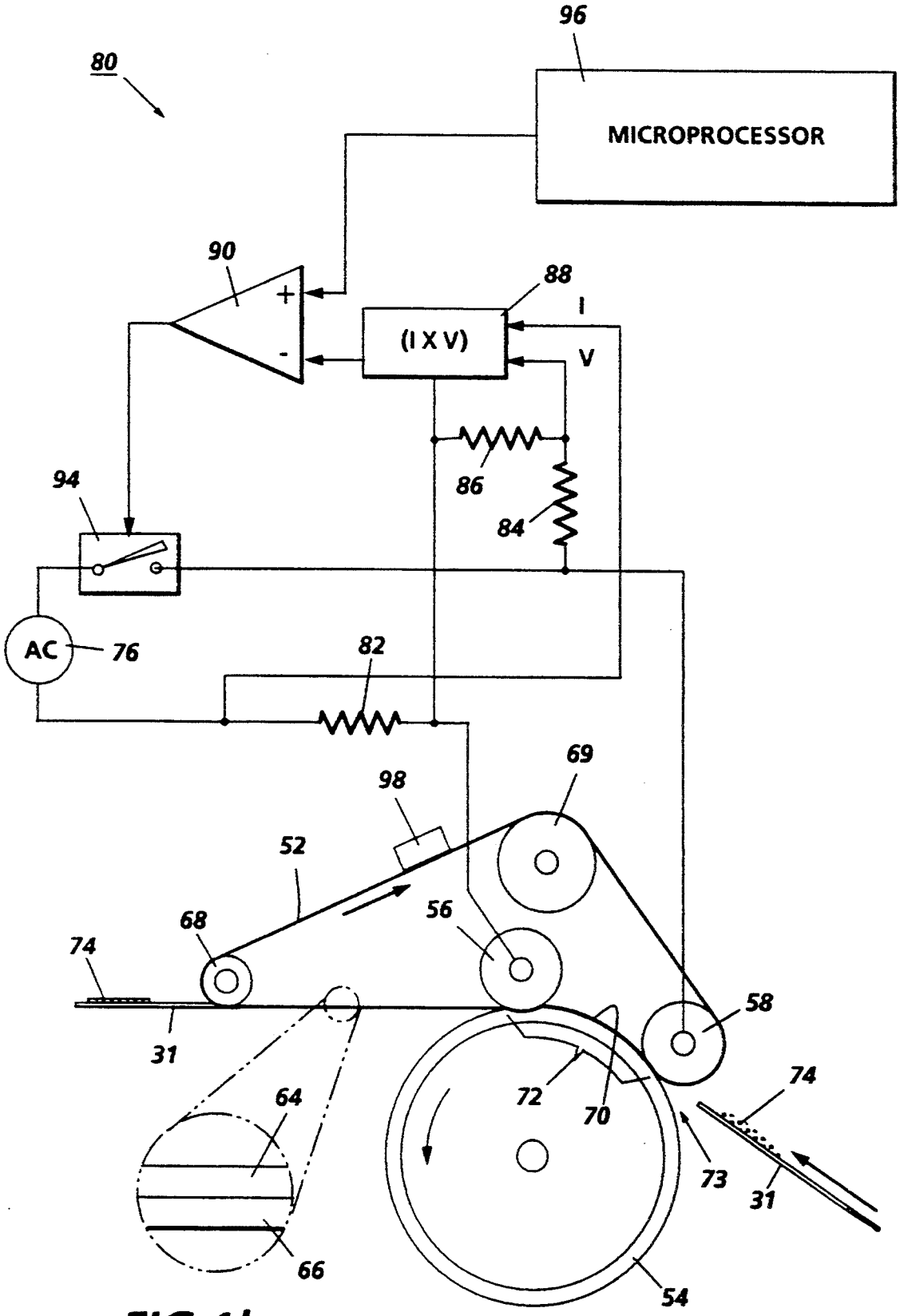

FIG. 1*a* is a schematic illustration of a fusing apparatus and a circuit diagram of a power controller for a belt fuser according to the invention.

FIG. 1*b* shows details of the fuser belt of FIG. 1*a*.

Figure 2:
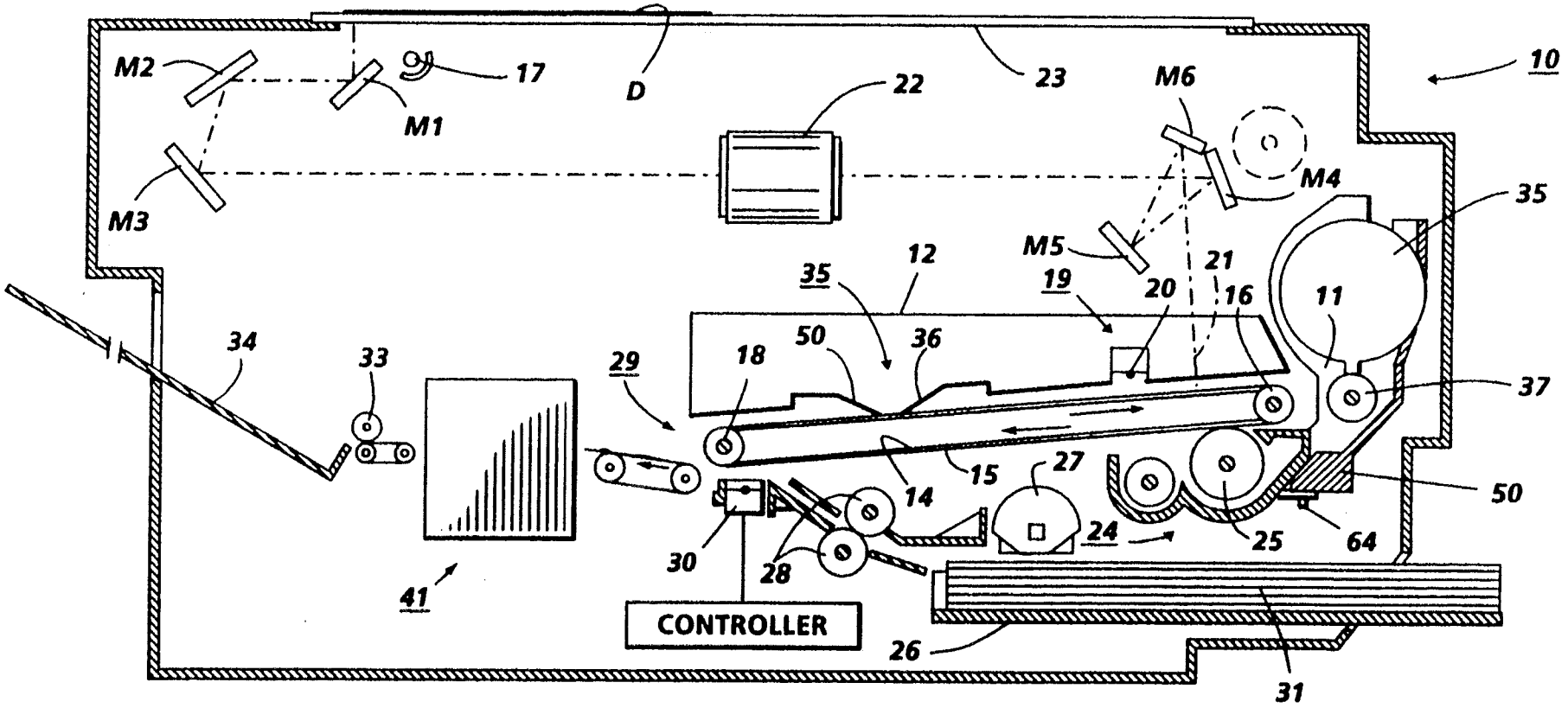

FIG. 2 is a schematic illustration of a printer/copier in which the fuser of FIG. 1*a* may be utilized.

DESCRIPTION OF THE PREFERRED EMBODIMENT OF THE INVENTION

Referring now to FIG. 2 there is shown by way of example, an automatic electrostatographic reproducing machine 10 which includes a removable processing cartridge 12. The reproducing machine depicted in FIG. 2 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems such as printers and is not necessarily limited in application to the particular embodiment shown herein.

The reproducing machine 10 illustrated in FIG. 2 employs a removable processing cartridge 12 which may be inserted and withdrawn from the main machine frame. Cartridge 12 includes an image recording belt-like member 14 the outer periphery of which is coated with a suitable photoconductive material 15. The belt or charge retentive member is suitably mounted for revolution within the cartridge about driven transport roll 16, around idler roll 18 and travels in the direction indicated by the arrows on the inner run of the belt to bring the image bearing surface thereon past a plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 30 in known manner preparatory to imaging. Thereafter, the uniformly charged portion of the belt 14 is moved to exposure station 21 wherein the charged photoconductive surface 15 is exposed to the light image of the original input scene information, whereby the charge is selectively dissipated in the light exposed regions to record the original input scene in the form of an electrostatic latent image.

The optical arrangement creating the latent image comprises a scanning optical system including lamp 17 and mirrors M1, M2, M3 mounted to a scanning carriage (not shown) to scan an original document D on an imaging platen 23. Lens 22 and mirrors M4, M5, M6 transmit the image to the photoconductive belt in known manner. The speed of the scanning carriage and the speed of the photoconductive belt are synchronized to provide faithful reproduction of the original document. After exposure of belt 14 the electrostatic latent image recorded on the photoconductive surface 15 is transported to development station 24, wherein toner is applied to the photoconductive surface 15 of the belt 14 rendering the latent image visible. The development station includes a magnetic brush development system including developer roll 25 utilizing a magnetizable developer mix having course magnetic carrier granules and toner colorant particles supplied from developer supply 11 and auger transport 37.

Sheets 31 of final support material are supported in a stack arranged on elevator stack support tray 26. With the stack at its elevated position, a segmented feed and sheet separator roll 27 feeds individual sheets therefrom to a registration pinch roll pair 28. The sheet is then forwarded to a transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt due to the beam strength of the support material 31 as it passes around the idler roll 18. The sheet containing the toner image thereon is advanced to fusing station 41 comprising a seamless, heated fuser belt structure 52, pressure roll 54 and a plurality of fuser roll structures 56 and 58.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 at a cleaning station 35 which comprises a cleaning blade 36 in scraping contact with the outer periphery of the belt 14. The particles so removed are contained within cleaning housing (not shown) which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

As disclosed in FIG. 1*a*, the fusing apparatus according to the present invention comprises the seamless belt structure 52 having a electrically resistive polyimide layer 64 and a release layer 66 (Figure 1*b*). The belt is entrained about the fuser rollers 56 and 58 as well as a stripping roller 68 and an idler roller 69. The rollers 56 and 58 are electrically conductive contact rollers which are electrically biased for applying voltages across a belt segment 70. By contact is meant, that the fusing rollers contact the resistive layer 64. The use of a seamless belt construction is an important aspect of the invention in that a seamed belt is subject to arcing and wear at each make and break with the contact rollers. When a seamless belt construction is used there is no breaking of electrical contact to the belt thereby eliminating arcing and wear.

The pressure roller 54 cooperates with the rollers 56 and 58 and the belt fusing segment 70 disposed therebetween to form a fusing zone 72 through which substrates or sheets 31 carrying toner images 74 thereon are passed for fusing the toner images to the substrates. A total nip pressure of approximately 50 lbs. is exerted between the fuser roll 56 and the pressure roll 54 by conventional structure used for that purpose.

Electrical power for elevating the temperature of the fusing belt segment 70 is provided by AC power source 76. The power source 76 is applied between the fusing zone entrance roller 58 and and exit fusing roller 56 as depicted in FIG. 1*a*.

In operation, the magnitude of the power supplied to the fusing belt segment 70 is designed to cause the toner forming the images to melt and fuse to the substrate 31. The application output of the power source 76 to fusing zone 72 is controlled using control circuitry 80.

The control circuitry 80 measures the power in the belt by monitoring the voltage across the belt segment 70 and the current flowing through it and determines the power by multiplying the current times the voltage ($I \times V$).

A 0.01 ohm resistor 82 is used to sense the current and develops 0.01 volts/amp. The power source 76 (typically 110 V AC line) voltage is divided by 18 by the 170 k and 10K ohm resistors, 84 and 86 respectively. This low voltage is then fed along with the current signal from the 0.01 ohm resistor 82 to an analog multiplier 88. The analog multiplier output is proportional to belt power consumption and is compared using a comparator 90 to a set point that is varied in level depending on the running history of the fuser. The output from the comparator 90 serves to actuate a solid state relay 94 for controlling the power supplied to the fusing segment 70 of the belt fuser. A microprocessor 96 varies the set point according to the run history of the fuser.

A reduction to practice was made using a simple exponential decay to decrease the power set point from a cold start with another exponential used to increase the power set point while the system is at rest. Fuser variables are defined as follows:

Steady state power—The power when system is fully warmed up

Boost power—Additional power added to SSP for cold start.

Warmup Time Constant—Time constant of exponential decay, (how fast BP decreases)

Cooldown Time Constant—Time constant of exponential increase, (how fast BP increases during fuser off state)

Typical set points for a 2 in/sec process speed:

Steady State Power (SSP)=25 Watts/In

Boost Power (BP)=25 Watts/In

The cold starting power will be SSP+BP or 25+25=50 Watts/In

Warm-Up Time Constant (WTC)=120 sec

Cooldown Time Constant (CTC)=875 sec

A pad 98 containing a suitable release agent material such as silicone oil is supported in wiping contact with the surface of the belt 52 Thus, the belt surface is thinly coated with silicone oil to prevent toner powder particles from adhering to it.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. A method of treating toner images with heat pursuant to adhering said images to a final substrate, said method including the steps of:

supporting an electrically resistive belt for movement in an endless path;

moving said resistive belt in contact with a portion of a pressure roll to form a fusing zone through which substrates carrying toner images are passed with the toner images contacting one surface of said belt;

applying an electrical bias across a segment of said belt to provide current flow through said segment for heating said segment for supplying heat to said toner images, said electrical bias being applied while said segment is in said fusing zone;

determining the power dissipation of said segment and comparing it to a reference value, said step of determining power dissipation comprises using a signal representative of the current supplied to said rollers and another signal representative of the applied voltage between said rollers; and using the results of said comparison for controlling the supply of power to said segment.

2. The method according to claim 1 wherein said another signal is generated by passing said applied voltage through a voltage divider prior to its being processed.

3. The method according to claim 2 wherein said step of determining comprises using an electronic signal multiplier device.

4. The method according to claim 3 wherein said reference value is a function of the on-off cycling of the fuser.

5. The method according to claim 1 wherein step of supporting said electrically resistive belt comprises using a plurality of rollers two of which cooperate with said pressure roll to form said fusing zone and wherein said step of applying an electrical bias comprises applying said bias across said two rollers.

6. Apparatus for treating toner images with heat pursuant to adhering said images to a final substrate, said comprising:

means for supporting an electrically resistive belt for movement in an endless path;

means for moving said resistive belt in contact with a portion of a pressure roll to form a fusing zone through which substrates carrying toner images are passed with the toner images contacting one surface of said belt;

means for applying an electrical bias across a segment of said belt to provide current flow through said segment for heating said segment for supplying heat to said toner images, said electrical bias being applied while said segment is in said fusing zone;

means for determining the power dissipation of said segment and comparing it to a reference value, said means for determining power dissipation comprising means for using a signal representative of the current supplied to said rollers and another signal representative of the applied voltage between said rollers; and means for controlling the supply of power to said segment in response to said comparison.

7. Apparatus according to claim 6 wherein said applied voltage signal is generated by passing said another through a voltage divider prior to its being processed.

8. Apparatus according to claim 7 wherein said means for determining comprises using an electronic signal multiplier device.

9. Apparatus according to claim 7 wherein said reference value is a function of the on-off cycling of the fuser.

10. Apparatus according to claim 6 wherein means for supporting said electrically resistive belt comprises means for supporting it with a plurality of rollers two of which cooperate with said pressure roll to form said fusing zone nip and wherein said means for applying said bias across said two rollers.

* * * * *